US005348454A

United States Patent [19]

Murphy

[11] Patent Number: 5,348,454

[45] Date of Patent: Sep. 20, 1994

[54] LIQUID PUMP RESILIENT INLET INSERT FOR PUMPING HIGH SOLIDS CONTENT LIQUIDS

[75] Inventor: Edward P. Murphy, Blaine, Minn.

[73] Assignee: Graco Inc., Golden Valley, Minn.

[21] Appl. No.: 67,726

[22] Filed: May 26, 1993

[51] Int. Cl.[5] ..... F04B 21/02

[52] U.S. Cl. ..... 417/554; 417/569; 137/533.15

[58] Field of Search ..... 417/554, 567, 569, 570; 137/533.11, 533.15

[56] References Cited

U.S. PATENT DOCUMENTS

| | | | |
|---|---|---|---|
| 2,790,460 | 4/1957 | Radd | 137/533.15 |
| 3,327,635 | 6/1967 | Sachnik | 137/533.15 |
| 3,346,008 | 10/1967 | Scaramucci | 137/533.15 |
| 3,620,653 | 11/1971 | Gaylord | 137/533.15 |
| 4,086,936 | 5/1978 | Vork | 417/554 |
| 4,775,303 | 10/1988 | Liska | 417/554 |
| 4,945,945 | 8/1990 | Schmid | 137/533.15 |
| 5,232,014 | 8/1993 | Hiltebrand | 137/533.15 |

FOREIGN PATENT DOCUMENTS

| | | | |
|---|---|---|---|
| 1550530 | 10/1969 | Fed. Rep. of Germany | 137/533.15 |
| 55-93976 | 7/1980 | Japan | 417/554 |

*Primary Examiner*—Richard A. Bertsch
*Assistant Examiner*—Roland G. McAndrews, Jr.
*Attorney, Agent, or Firm*—Palmatier, Sjoquist & Helget

[57] ABSTRACT

A liquid pump adapted for pumping liquids containing high percentages of solids in suspension, including a foot valve and pumping chamber, and having an insert in the pumping chamber adjacent the foot valve seat, the insert having a resilient inner surface and an outer metallic rim, the inner resilient surface forming flanges about the edges of the rim, and the insert being clamped between the valve seat and another member.

6 Claims, 1 Drawing Sheet

LIQUID PUMP RESILIENT INLET INSERT FOR PUMPING HIGH SOLIDS CONTENT LIQUIDS

BACKGROUND OF THE INVENTION

The present invention relates to liquid pumps; more particularly, the invention relates to liquid pumps adapted for pumping liquids having extremely high solids content.

Liquid pumps have long been used for pumping liquids of varying viscosities, including very low viscosity oils and paints, and medium to high viscosity liquids which have a rather slow flow characteristic. In a case of paints and other coating materials it is typical for liquid pumps to handle such materials having a solids content in the range of 30%–40%. However, when the solids content of such materials exceeds about 40% the pumping problem becomes more difficult, and special handling problems have to be taken into account. Liquid materials having higher solids content tend to build up and accumulate within the pump and can seriously degrade pumping efficiency, even to the point of disabling the pump from effective operation. It is necessary to frequently disassemble the pump components for cleaning, so as to remove accumulated solids from adhering to the various components on the interior of the pump and to return the pump to normal operating efficiency. Such pumps therefore require frequent maintenance intervals, wherein the pump must be removed from operation and disassembled for cleaning.

A particular problem in the pumping of high solids content materials has been the tendency of the solid particulates in the pumped material to build up or "pack" along portions of the interior walls of the pumping cylinder. One area where this problem has been noticed is in the region immediately adjacent the intake valve of the pump, which frequently has a void or recess which tends to be outside of the flow path of the liquid flowing through the pump. Solid particulate matter which becomes lodged in this region is not influenced by the material flow through the pump, and therefore it tends to accumulate along the interior pump walls and to gradually pack the walls with increasing amounts of material. As this buildup increases it can degrade the operating efficiency of the pump, and in extreme cases can even disable the pump from further operation.

It would be a significant advantage in the art to provide a liquid pump for pumping high solids content materials wherein the solids content may range from 70%–80%, and wherein the frequency of maintenance intervals may be reduced in order to permit the pump to continue in operation for longer time periods.

Modern coating materials having high solids content typically include particulate matter in order to provide a textured coating on a surface, and the solids content of such coating materials can include particulate matter up to and including particles such as sand or grit having a cross-sectional dimension of 2–3 millimeters (mm). Materials of this general type are exceedingly difficult to pump, not only because of the buildup of solids within the pump itself, but also because of the difficulty in maintaining a relatively steady flow of the particulate matter through the pump.

SUMMARY OF THE INVENTION

The present invention incorporates an annular insert into the pumping chamber of a pump adapted for pumping high solids content liquids, including liquids having particulate matter suspended therein. The insert is positioned adjacent to the foot valve seat, to prevent the coating material and particulate matter from packing the pumping chamber, and to continuously self-clean so as to move particulate matter into the liquid flow stream as it passes through the pump. The insert includes an outer rim which is molded to an inner cushion of resilient material, and which is compressibly secured against the foot valve seat.

It is the principal object of the present invention to provide a self-cleaning insert in a liquid pump for preventing accumulation and buildup of material during the pump operation.

It is another object and advantage of the present invention to provide a high solids content pump for continuous use without frequent maintenance intervals.

Other objects and advantages of the invention will become apparent from the following specification and claims, and with reference to the appended drawings.

DESCRIPTION OF THE PREFERRED EMBODIMENT

Figure 1:
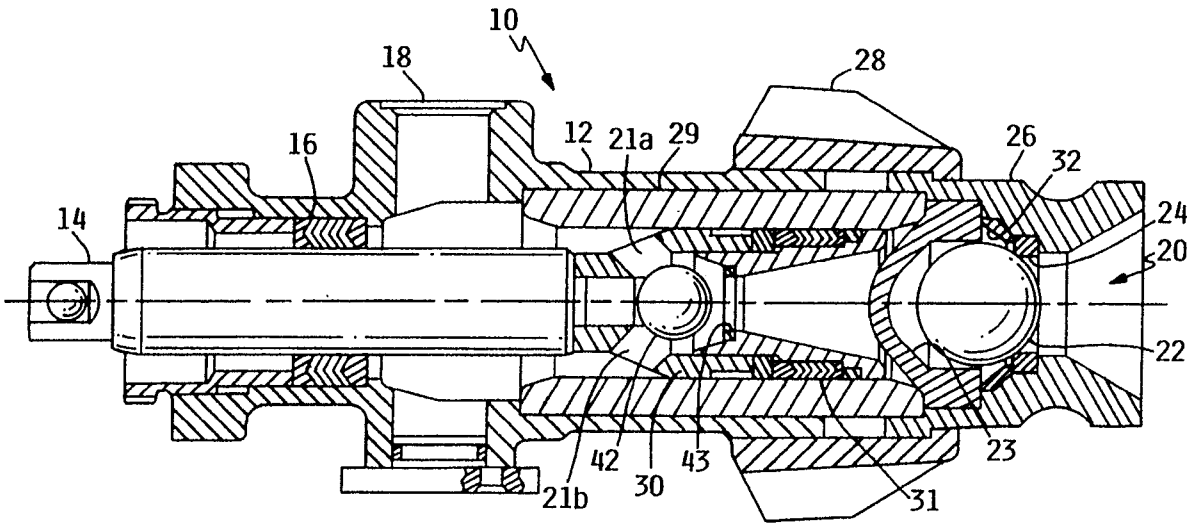
FIG. 1 shows the invention in cross-section view, formed as a part of a liquid pump.
Figure 3:
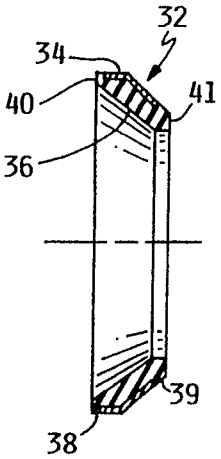
FIG. 3 shows a cross-section view of the invention taken along lines 3—3 of FIG. 2.
Figure 2:
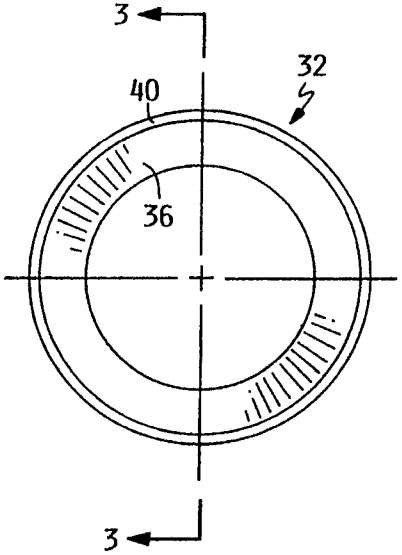
FIG. 2 shows an elevation view of the invention.

Referring to the figures, a liquid pump 10 is formed of a pump body 12 which supports and contains the internal pump components. A piston rod 14 is adapted for connection to a suitable reciprocable driving force, and piston rod 14 is sealably movable within body 12 by seals 16. Piston rod 14 is affixed to a piston 30 which is reciprocably mounted within a cylinder 29. Piston 30 has seals 31 for maintaining a tight liquid seal against the interior surface of cylinder 29. A liquid outlet 18 is provided for the passage of the pumped liquid, and an inlet 20 receives the liquid. The liquid passes through chambers within the pump, including piston passages 21*a* and 21*b*, and then passes via outlet 18. A foot valve 22 blocks the flow passage through the pump during one stroke direction of the piston by sealably engaging against a seat 24. A piston valve 42 sealably blocks the flow passages through the piston during one stroke direction by engagement against seat 43. A ball stop 23 limits the travel excursion of foot valve 22.

The foot valve 22, its seat 24, and ball stop 23 are all contained within an intake housing 26. Intake housing 26 is threadably clamped against the lower end of body 12 by a threadable housing locknut 28. An insert 32 is compressibly clamped between ball stop 23 and seat 24 when the housing locknut 28 is secured.

Insert 32 has an outer rim 34 which is preferably made from stainless steel or the like, and an inner cushion 36. Inner cushion 36 is preferably a resilient material such as rubber, formed by a molding process, wherein the molding process includes outer rim 34 so as to bond the resilient inner cushion 36 permanently to the outer rim 34. Resilient inner cushion 36 has an inner face 40 which is positioned against a lower surface of ball stop 23, and has an outer cushion face 41 which is positioned against the upper surface of valve seat 24. Valve seat 24 is affixed in intake housing 26 by silver soldering, or equivalent bonding techniques. Cushion 36 has an inner flange 38 which extends about an edge of outer rim 34, and cushion 36 has an outer flange 39 which extends about the other edge of outer rim 34. In this manner, the insert 32 is clamped between ball stop 23 and valve seat 24 by compressing the inner face 40 and outer face 41 of resilient inner cushion 36. The bonded outer rim 34 prevents excessive deformation of the inner cushion 36.

In operation, insert 32 is secured in compressible position between ball stop 23 and seat 24. Outer rim 34 limits the degree of deformity to which insert 32 is subjected, and functions to securely hold insert 32 in the intake housing 26.

During operation of the pump the piston undergoes a compression stroke and a suction stroke; during the compression stroke the high solids content material within the cylinder chamber is pressed against the interior walls of the cylinder, including the inner surface of inner cushion 36. The particulate matter suspended in the material tends to deform inner cushion 36. During the suction stroke of the piston a sudden drop in pressure occurs within the cylinder and the deformity of the cushion is relieved, and the cushion expels particulate and other matter adhering to its surface. This material is returned into the flow stream of the liquid passing through the pump, and accumulations of material within the cylinder are thereby avoided. As a result, frequent maintenance intervals of the pump required formerly for cleaning out the interior portions of the pump are no longer required with the present invention.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A liquid pump adapted for pumping liquids having high solids content, comprising:

a) a pump housing having an inlet and an outlet, and a piston within a cylinder inside said housing;

b) a pumping chamber inside said housing between said cylinder and said inlet, said pumping chamber having walls having a predetermined maximum first diameter and an inward taper toward said inlet;

c) a ball valve element in said pumping chamber and a valve seat element positioned at said inlet, said ball valve element having a second diameter, less than said first diameter, said seat element having an inside third diameter less than said second diameter; and d) a resilient insert in said chamber, said insert affixed against said pumping chamber walls and extending from said first diameter, along said inward taper, and to said valve seat element about a circumferential line having a diameter greater than said third diameter.

2. The apparatus of claim 1, further comprising an outer metallic rim affixed to said resilient insert, said metallic rim having respective edges.

3. The apparatus of claim 2, wherein said resilient insert further comprises edge flanges extending outside said respective edges of said outer metallic rim.

4. The apparatus of claim 3, further comprising a ball stop member inside said housing and positioned a predetermined distance from said seat, whereby to limit the movement of said ball valve element.

5. The apparatus of claim 4, wherein said resilient insert is clamped between said ball stop member and said seat, said flanges respectively engaging said ball stop member and said seat.

6. The apparatus of claim 5, wherein each of said flanges further comprises a facing surface respectively engaged against a surface of said ball stop and seat.

* * * * *